United States Patent [19]

Yamada

[11] Patent Number: 4,632,492

[45] **Date of Patent: * Dec. 30, 1986**

[54] ELECTRICAL CONNECTOR ASSEMBLY

[75] Inventor: Hiromi Yamada, Yokosuka, Japan

[73] Assignee: AMP Incorporated, Harrisburg, Pa.

[ * ] Notice: The portion of the term of this patent subsequent to Oct. 2, 2001 has been disclaimed.

[21] Appl. No.: 651,549

[22] Filed: Sep. 17, 1984

Related U.S. Application Data

[63] Continuation of Ser. No. 341,954, Jan. 22, 1982, Pat. No. 4,474,418.

[30] Foreign Application Priority Data

Jan. 24, 1981 [GB] United Kingdom ..... 8102192

[51] Int. Cl.[4] ..... H01R 13/05

[52] U.S. Cl. ..... 339/176 M; 339/17 C

[58] Field of Search ..... 339/65, 176 M, 191, 339/192, 195, 196, 252 P, 17 R, 17 C, 17 L, 17 LC, 217 S

[56] References Cited

U.S. PATENT DOCUMENTS

| | | | |
|---|---|---|---|
| 3,193,793 | 7/1965 | Plunkett et al. | 339/176 M |
| 3,325,771 | 6/1967 | Ruehlemann et al. | 339/17 R |
| 3,594,696 | 7/1971 | Witek, Jr. | 339/91 R |
| 3,601,775 | 8/1971 | Longenecker et al. | 339/217 S |
| 3,601,782 | 8/1971 | Vijmen | 339/176 MP |
| 3,796,921 | 3/1974 | Fischer | 339/17 CF |
| 3,960,434 | 6/1976 | Soes | 339/176 M |
| 4,296,991 | 10/1981 | Hughes et al. | 339/176 MP |

FOREIGN PATENT DOCUMENTS

| | | | |
|---|---|---|---|
| 2705853 | 8/1977 | Fed. Rep. of Germany | 339/252 R |
| 1203756 | 9/1970 | United Kingdom | 339/176 MP |

*Primary Examiner*—Neil Abrams

*Attorney, Agent, or Firm*—Robert W. J. Usher

[57] ABSTRACT

An electrical connector assembly for mounting on a printed circuit board comprises a first housing (31) carrying stamped and formed male contacts (41) having resilient, forked mating ends (43) each supported by a rib (37) in the first housing (31), and a second housing (11) carrying female contacts (22) with forked mating ends (43) of the male contacts (41).

8 Claims, 5 Drawing Figures

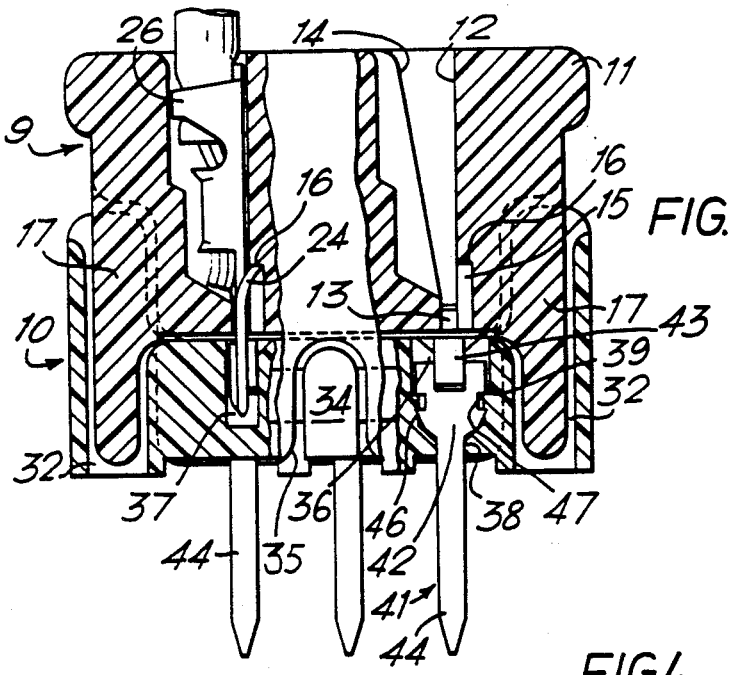
FIG.2.
FIG.3.
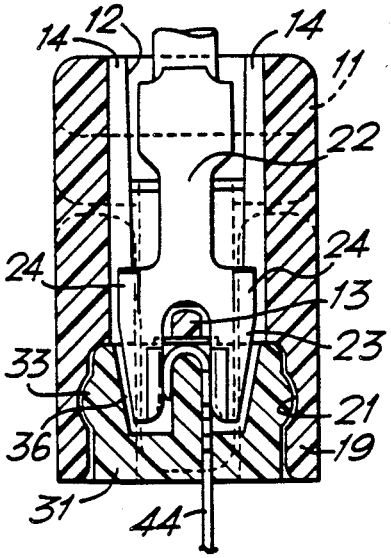
FIG.4.
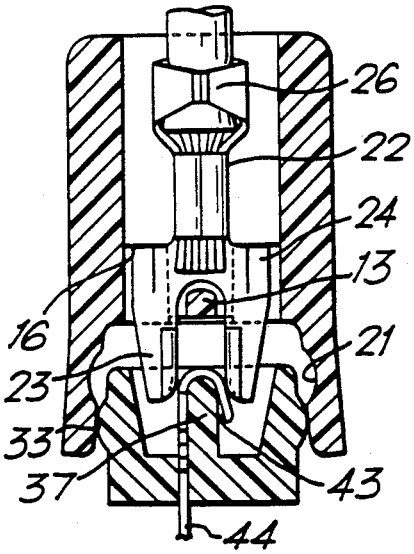

ELECTRICAL CONNECTOR ASSEMBLY

This is a continuation of application Ser. No. 341,954, filed Jan. 22, 1982, now U.S. Pat. No. 4,474,418.

The invention relates to an electrical connector assembly for mounting on a printed circuit board.

It is often desirable that electrical connector assemblies for mounting on printed circuit boards be of low profile, that is, upstand only a small distance above the surface of the printed circuit board, to permit a plurality of printed circuit boards to be closely spaced together in compact electronic equipment.

A know electrical connector assembly for mounting on a printed circuit board, comprises a post header including a row of post contacts fixed in a first insulating housing with one end of each post contact extending out of the housing for receipt in a hole in the printed circuit board, and a female connector including a corresponding row of female contacts fixed in a second insulating housing and for mating with the other ends of the post contacts when the female connector and the post header are mated.

In this known assembly the post contacts are rigid and are gripped by cantilever or beam spring portions of resilient female contacts However, it is very difficult in practice to manufacture economically female contacts with a height of below 10 mm. If the female contacts are simple fork contacts, a reduction in their height achieved by a reduction in the length of the form arms would result in an increase in stiffness of the arms which would cause an undesirably high insertion force on mating with a post contact.

A further disadvantage of the known connector assembly is that a wall of the post header housing through which the post contacts extend must be relatively thick to provide sufficient support for the post contacts to resist deflection thereof during mating. This thickness contributes to the overall height of the assembly as the female contacts can engage only those portions of the post contacts extending above the wall surface.

According to the invention, the other end of each post contact is turned back to define a resilient hooked portion which extends about a supporting rib which upstands from a wall of the first housing in the mating direction with the free end of the hooked portion spaced from the wall, and in that the female contacts are each forked to receive the hooked portion of a respective post contact in an interference fit.

The assembly of this invention has the advantage that the resilient end of each post contact provides only a relatively small resistance to insertion in the associated forked female contact which may, therefore, have relatively short stiff arms. As the supporting rib extends in the mating direction, it supports the post contact during insertion and assists in preventing deformation of the post contact caused, for example, by misalignment of the mating parts. The thickness of the wall of the first housing through which the post contacts extend can therefore be reduced. Furthermore, each female contact can engage the associated post contact below the upper level of the rib enabling location of the female contact more close to the surface of the printed circuit board.

The resilient post contacts can be stamped and formed from sheet metal and thus will require less material in manufacture than the prior rigid post contacts, and may also more easily be provided with integral teeth adapted to anchor the posts in the housing.

It will be appreciated that, in an alternative arrangement, the female contacts may be mounted in the first, header housing and the post contacts may be mounted in the second housing.

An electrical connector assembly according to this invention will now be described by way of example with reference to the drawings, in which:

FIG. 2 is a side view of a connector assembly according to this invention with portions shown in different planes of cross-section;

FIG. 3 is a transverse cross-sectional view of the assembly of FIG. 2;

FIG. 4 is a transverse cross-sectional view of the assembly of FIG. 2 taken in an opposite direction to FIG. 3 showing the post header and female connector during mating.

Figure 1:
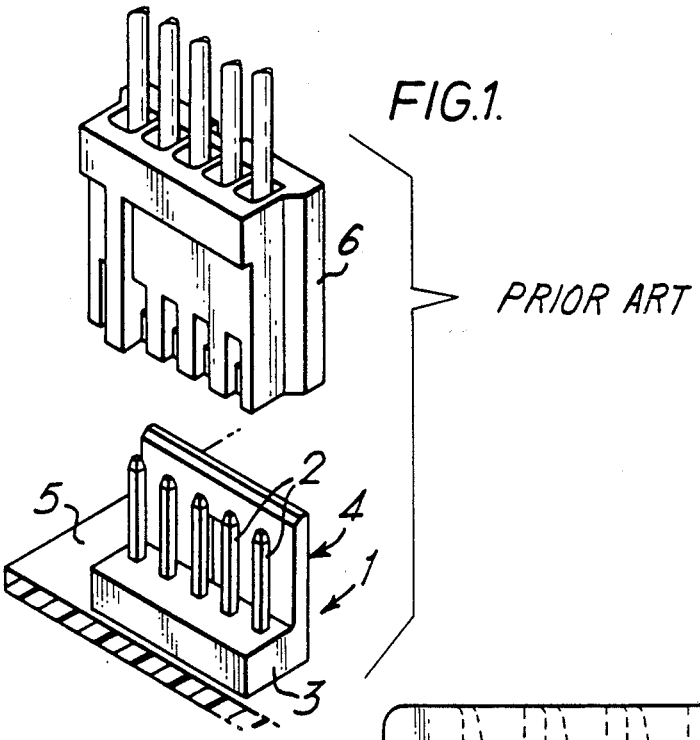
FIG.1. PRIOR ART
FIG. 1 is a perspective view of a known connector assembly.

The known connector assembly shown in FIG. 1, comprises a post header 1 including a row of rigid posts 2 fixed to extend through a thick base wall 3 of a housing 4 and anchored at one of their ends in a printed circuit board 5. A mating female connector includes a corresponding row of resilient female contacts (not shown) fixed in a second insulating housing 6 for connection to the other ends of the post contacts 2.

As shown in FIGS. 2, 3 and 4, the electrical connector assembly according to this invention comprises a female connector 9 matable with a post header 10.

Figure 5:
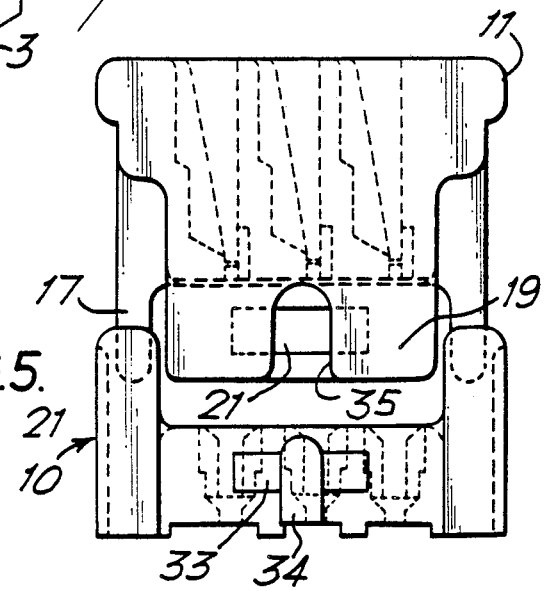
FIG. 5 is a side view of the connector assembly housings aligned for mating.

The female connector comprises an insulating housing 11 (FIG. 5) moulded in one-piece of plastics material with contact receiving cavities 12 communicating with rear and mating faces. A contact stop 13 is integrally formed with cavity end walls to extend across the cavities adjacent the mating face. A pair of spaced, parallel contact guiding ramps 14 extend along respective end walls to guide a female contact 22 inserted into the cavity through the rear face towards the stop 13. A recess 15 providing a contact retaining shoulder 16 is formed adjacent each side wall on opposite sides of each stop 13. Guiding posts 17 are integrally formed on opposite ends of the female housing, and the side walls extend below the cavities to define flexible latching skirts 19 formed with latching depressions 21.

Each female contact 22 is stamped and formed from sheet metal with a wire crimping portion 26 at a rear end and a fork 23 at a mating end. Locking lances 24 are provided at the root ends of the fork arms enabling the female contact to be retained in the housing with their arms protruding from the mating face by insertion, fork first, through the rear face until the fork crotch engages the stop 13 and the lances 24 snap behind shoulders 16. Flanges are bent up from inner edge portions of the fork arms to provide contact surfaces of larger area than the stock thickness.

The post header 10 comprises an insulating housing 31 moulded in one-piece of plastics material with sockets 32 formed at opposite ends for receiving the guiding posts 17 and latching protuberances 33 (FIGS. 3 and 4) for receipt in depressions 21 to latch the housings together. A coding projection 34 is formed on one side wall for receipt in a slot (not shown) formed in a skirt 19 of the female housing.

A series of post receiving cavities 36 is formed in the housing 31 and a contact supporting rib 37 upstands centrally from each cavity floor adjacent a post receiving aperture 38. On the side of the rib adjacent the aperture 38 the end walls of each cavity are stepped inwardly as they extend from the mating face to provide spaced contact supporting shoulders 39 on each end of the cavity.

Each post contact 41 is a resilient stamped and formed metal strip comprising a body part 42 from opposite ends of which extend a turned-back portion providing a resilient hook 43 and a leg 44, respectively. As seen from FIG. 4, the free end of the hook 43 normally diverges from the body opposite edge portions of which are rebated to define retention tangs 46 and supporting shoulders 47.

The contacts 41 are each inserted into a respective cavity through the mating face of the housing 31 with the leg 44 received as a force fit in the aperture 38, the tangs 46 engaging the stepped ends walls and the shoulders 47 engaging shoulders 39. The rib 37 is received as a free fit in the hooked portion 43.

On mating the female connector 9 with the post header 10 on a printed circuit board, the hooked portion 43 of each contact post 41 is received as an interference fit in the fork of the associated female contact 22. The maximum resilient deflection occurs in the free end of the hooked portion 43, this providing a low resistance to insertion and a reliable electrical connection.

It should be noted that, although the fork arms of each female contact 22 engage the hooked portion 43 of the associated post contact 41 on both sides of the supporting rib 37, the rib 37 does not contribute to the force establishing electrical connection, since the sum of the thickness of the rib 37 plus twice the stock thickness of the hooked portion 43 is less than the minimum separation of the fork arms of the female contact 22. However, the rib 37 assists in supporting the hooked portion 43 during mating.

It should also be noted (from FIG. 4) that the maximum deflection of the latching skirts 19 occurs prior to deflection of the hooked portions 43 of the post contacts 41, the progressive engagement of the latching protuberances 37 and depressions 21 subsequently urging the connectors 9 and 10 together and thus assisting in reducing the net insertion force.

An additional advantage associated with the use of a substantially flat fork contact with a suitably orientated conventional wire crimping portion for each female contact is that close spacing of the female contacts is possible as the height of the crimping portion is less than the width thereof.

What is claimed is:

1. An electrical connector, comprising:

a first insulating housing member having a contact-receiving cavity, a supporting rib member located in said contact-receiving cavity, a first electrical contact member extending upwardly from a base of said housing having a first section and a second section, said first section secured in said housing member and said second section being a formed flat metal strip turned back in a substantially inverted U-shape to define a contact section in the form of a resilient hook member disposed about and receiving said supporting rib member in said contact-receiving cavity as a free fit with a free end of the hook member spaced from the rib; with the uppermost portions of the resilient hook being curved about and engageably supported by the upper surface of the rib; and a second insulating housing member matable with said first housing member, a second electrical contact member secured in said second insulating housing member, said second electrical contact member having a forked contact section that includes contact surfaces along opposing surfaces that electrically engage respective surfaces of said resilient hook member there along in an interference fit within said contact-receiving cavity when said first and second housing members are mated.

2. An electrical connector as set forth in claim 1, wherein said first insulating housing member has a contact-receiving passageway in communication with said contact-receiving cavity, and means provided by said contact-receiving passageway and said first section of said electrical contact member securing said first electrical contact member in said first insulating housing member.

3. An electrical connector as set forth in claim 1, wherein said second insulating housing member has a contact-receiving passageway extending therethrough, and means provided by said contact-receiving passageway and said second electrical contact member securing said second electrical contact member in said second insulating housing member.

4. An electrical connector, comprising:

a first, one-piece, insulating housing member having a supporting rib member extending outwardly from an upper surface of said first housing member, a first electrical contact member secured in said first housing member and including a contact section constituted for a formed flat metal strip turned back in a substantially inverted U-shape to define a resilient hook member diposed about and receiving said supporting rib member as a free fit with the uppermost portions of the resilient hook being curved about and engageably supported by the upper surface of the rib; and a second insulating housing member matable with said first housing member, a second electrical contact member secured in said second insulating housing member, said second electrical contact member having a forked contact section that includes contact surfaces of said resilient hook member there along in an interference fit thereby electrically connecting said first contact member with said second electrical contact member when said first and second housing members are mated.

5. An electrical connector as set forth in claim 4, wherein said first insulating housing member includes a contact-receiving cavity in which said supporting rib member is located.

6. An electrical connector assembly comprising a post header including a row of post contacts fixed in a first insulating housing with mating ends of the post contacts upstanding from a housing wall and a female connector including a corresponding row of female contacts fixed in a second insulating housing for mating with the mating ends of the post contacts when the female connector and post header are mated, a supporting rib upstanding from the wall of the first housing in the mating direction adjacent the post contacts, each post contact being a formed, flat metal strip, the mating end of which is turned back in a substantially inverted U-shape to define a resilient hooked portion which extends about and receives the supporting rib as a free fit within the hooked portion with the uppermost portions of the resilient hook being curved about and engageably supported by the upper surface of the rib a free end of the hooked portion spaced from the rib, the female contacts each being shaped to receive the hooked portion of a respective post contact in an interference fit.

7. An electrical connector assembly according to claim 6 in which the female contacts each have a forked contact section providing spaced contact surfaces engaging the surface of the hooked portion when the female connectors and post header are mated.

8. An electrical connector according to claim 6 in which each post contact has a leg received as a force fit in an aperture in the wall of the first housing adjacent the associated supporting rib.

* * * * *